US009061853B2

(12) United States Patent
Okabe

(10) Patent No.: US 9,061,853 B2
(45) Date of Patent: Jun. 23, 2015

(54) IMAGE FORMING APPARATUS HAVING PROCESS UNIT AND TRAY

(71) Applicant: Brother Kogyo Kabushiki Kaisha, Nagoya-shi, Aichi-ken (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/292,000

(22) Filed: May 30, 2014

(65) Prior Publication Data

US 2014/0353903 A1 Dec. 4, 2014

(30) Foreign Application Priority Data

May 31, 2013 (JP) ..... 2013-116463

(51) Int. Cl.
*B65H 3/44* (2006.01)
*B65H 5/26* (2006.01)
*G03G 15/00* (2006.01)

(52) U.S. Cl.
CPC ..... *B65H 3/446* (2013.01); *B65H 5/26* (2013.01); *B65H 2407/21* (2013.01); *G03G 15/6514* (2013.01); *G03G 2215/00392* (2013.01)

(58) Field of Classification Search
CPC ..... B65H 2407/21; B65H 3/446; B65H 5/26; G03G 15/6514; G03G 2215/00392
USPC ..... 271/9.09, 145, 9.11; 399/392
See application file for complete search history.

(56) References Cited

U.S. PATENT DOCUMENTS

| | | | | |
|---|---|---|---|---|
| 4,196,898 | A * | 4/1980 | Misawa et al. | 271/9.08 |
| 7,871,067 | B2 * | 1/2011 | Lim | 271/9.13 |
| 8,824,952 | B2 * | 9/2014 | Nishimura | 399/392 |
| 2008/0012199 | A1 * | 1/2008 | Kim et al. | 271/9.09 |
| 2008/0143046 | A1 * | 6/2008 | Nishii et al. | 271/264 |
| 2010/0172678 | A1 * | 7/2010 | Kim | 399/393 |
| 2011/0293317 | A1 * | 12/2011 | Nakano et al. | 399/101 |
| 2014/0353902 | A1 * | 12/2014 | Okabe | 271/3.19 |

FOREIGN PATENT DOCUMENTS

JP 2008-292804 A 12/2008

* cited by examiner

*Primary Examiner* — Patrick Cicchino
(74) *Attorney, Agent, or Firm* — Banner & Witcoff, Ltd.

(57) ABSTRACT

In an image forming apparatus, a tray is configured to move between a first position inside an apparatus body and a second position outside the apparatus body. The tray allows a first recording medium to be conveyed from a first receiving portion of the tray when the tray is positioned in the first position. A supply part has a first opening and allows a second recording medium different from the first recording medium to be conveyed through the first opening. A conveying mechanism conveys, in the second direction, the second recording medium supplied from the supply part. The conveying mechanism includes a guide member disposed below the first receiving portion and configured to guide the second recording medium.

11 Claims, 7 Drawing Sheets

IMAGE FORMING APPARATUS HAVING PROCESS UNIT AND TRAY

CROSS REFERENCE TO RELATED APPLICATION

This application claims priority from Japanese Patent Application No. 2013-116463 filed May 31, 2013, the entire content of which is incorporated herein by reference.

TECHNICAL FIELD

The present invention relates to an image forming apparatus, and more particularly, to an electro-photographic type image forming apparatus.

BACKGROUND

There has been proposed a tandem type color printer in which a plurality of cartridges are attachable to and detachable from an apparatus body. The plurality of cartridges are arrayed in a cartridge tray, and the cartridge tray is slidably supported with respect to the apparatus body. This printer is described in Japanese Patent Application Publication No. 2008-292804, for example.

SUMMARY

It is an object of the invention to provide an improved image forming apparatus.

In order to attain the above and other objects, the invention provides an image forming apparatus which may include: an apparatus body; a process unit; a tray; a supply part; and a conveying mechanism. The process unit may have a photosensitive body extending in a first direction. The tray may have a first receiving portion configured to receive a first recording medium. The tray may be configured to move between a first position inside the apparatus body and a second position outside the apparatus body, a second direction being defined as a direction that intersects both of a vertical direction and the first direction and is directed from the second position to the first position. The tray may be configured to allow the first recording medium to be conveyed from the first receiving portion when the tray is positioned in the first position. The supply part may have a first opening and may be configured to allow a second recording medium different from the first recording medium to be conveyed through the first opening. The conveying mechanism may be configured to convey, in the second direction, the second recording medium supplied from the supply part. The conveying mechanism may include a guide member disposed below the first receiving portion and configured to guide the second recording medium.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of Printer

Figure 1A:
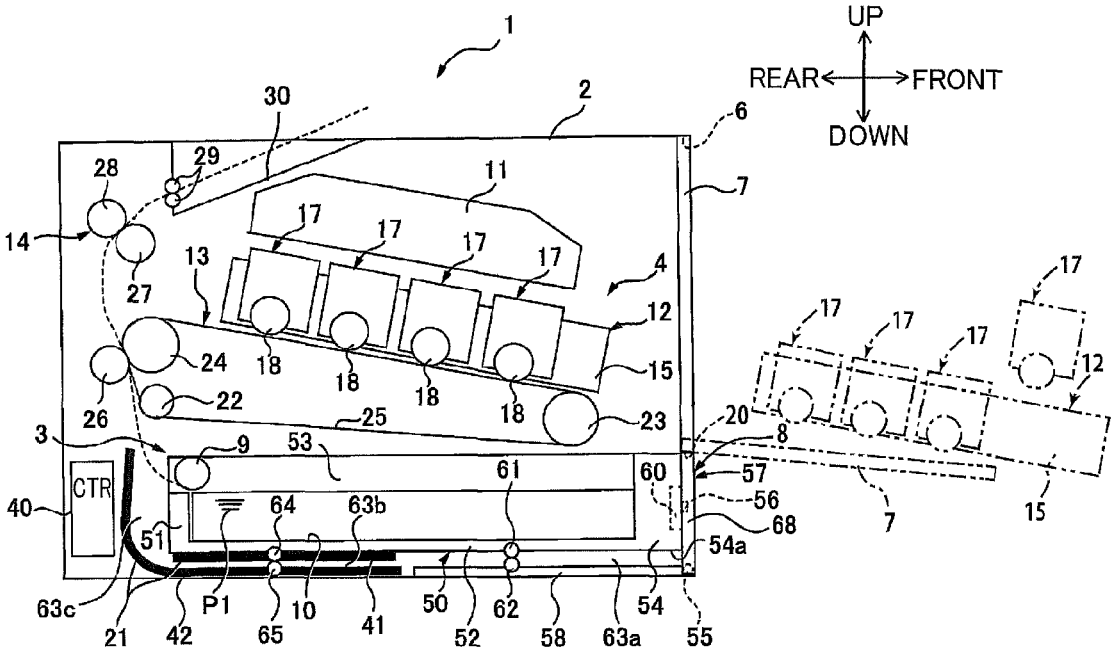
FIG. 1A is a cross-sectional view of a printer as an example of an image forming apparatus according to a first embodiment of the present invention, the cross-sectional view being taken along a widthwise center line of the printer and showing a closed state of a pivoting portion.

A printer 1 as an example of an image forming apparatus according to a first embodiment of the present invention will be described with reference to FIGS. 1A through 4. The printer 1 is a transverse-mounted type and intermediate image transfer type color laser printer. The printer 1 includes a main casing 2 as an example of an apparatus body, a sheet supply unit 3 for supplying a sheet, an image forming unit 4 for forming an image onto a sheet supplied by the sheet supply unit 3, and a controller 40 those provided in the main casing 2.

The terms "upward", "downward", "upper", "lower", "above", "below", "beneath", "right", "left", "front", "rear" and the like will be used throughout the description assuming that the printer 1 is disposed in an horizontal orientation in which it is intended to be used. In use, the laser printer 1 is disposed as shown in FIG. 1A in which the upper side of the printer 1 in FIG. 1A is considered the "upper side" of the printer 1, the lower side of the printer 1 in FIG. 1A is considered the "lower side" of the printer 1, the right side of the printer 1 in FIG. 1A is considered the "front side" of the printer 1, and the left side of the printer 1 in FIG. 1A is considered the "rear side" of the printer 1. Further, left and right sides of the printer 1 are defined based on the perspective of the user facing the front side of the printer 1. Thus, the near side of the printer 1 in FIG. 1A is considered the "left side," and the far side is considered the "right side." The left-right direction of the printer 1 is also referred to as a "widthwise direction" of the printer 1. Here, right-left direction is an example of a first direction. Further, a direction from the front to the rear is an example of a second direction, and the front side and the rear side are an example of an upstream side and a downstream side, respectively, in the second direction.

(1) Main Casing

The main casing 2 is of a box-shape having a generally rectangular side view, in which the sheet supply unit 3 and the image forming unit 4 are accommodated. The main casing 2 includes a front wall 5. The main casing 2 has a front opening 6 as an example of a second opening opened at the front wall 5. The main casing 2 also includes a front cover 7 pivotally movable about a lower end portion between a closed position closing the opening 6 as shown in FIG. 1A by a solid line and an open position opening the opening 6 as shown by a two dotted chain line in FIG. 1A.

(2) Sheet Supply Unit

The sheet supply unit 3 includes a sheet tray 8 and a sheet supply roller 9 as an example of a conveying mechanism.

Figure 4:
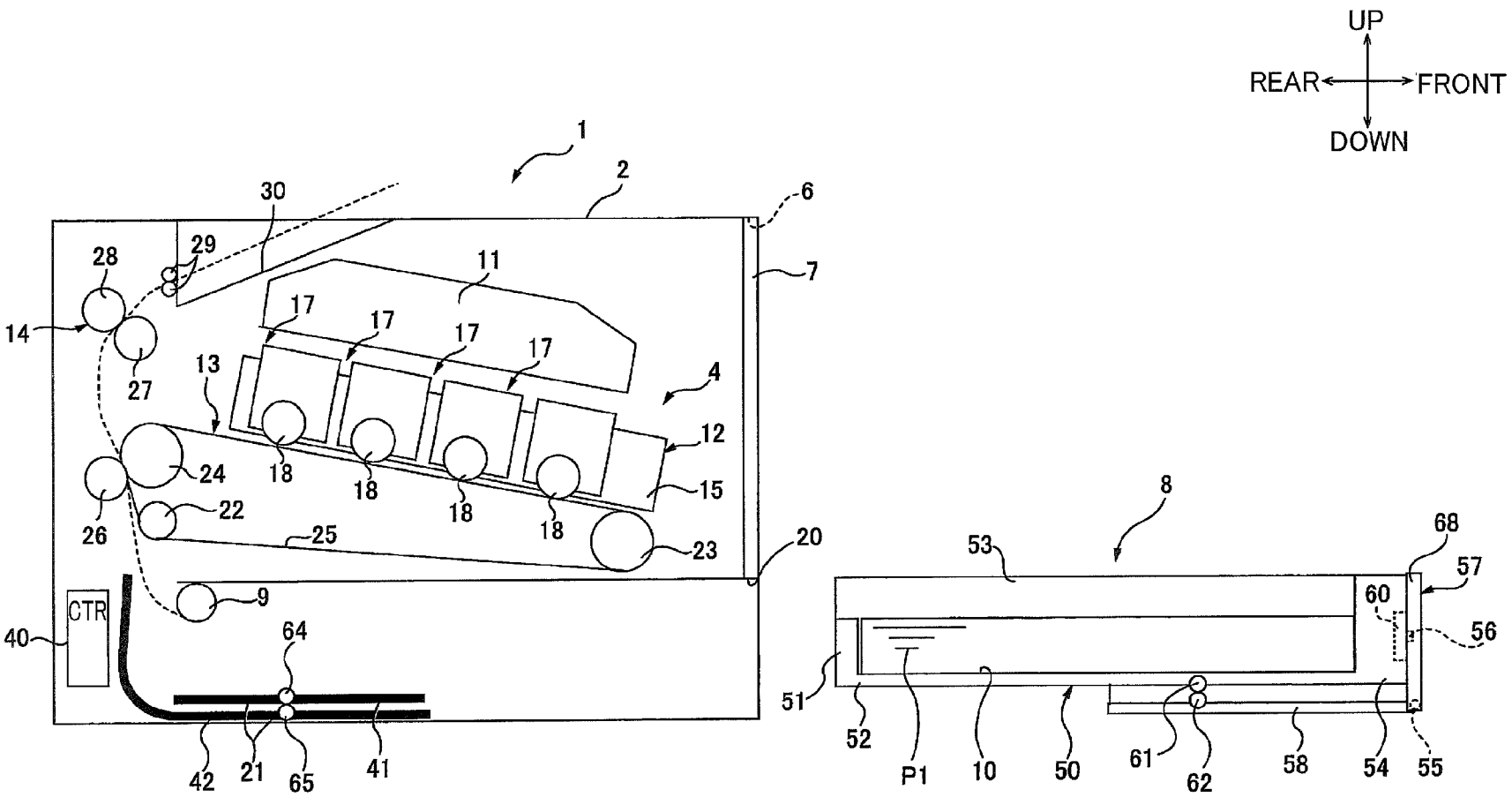
FIG. 4 is a cross-sectional view of the printer according to the first embodiment and showing a withdrawn state of a sheet tray.

The sheet tray 8 is removably mounted in a bottom portion of the main casing 2, and is generally rectangular shaped in side view and is box shaped with its upper end being open, and its inner space partitioned as a sheet accommodation chamber 10 as an example of a first receiving portion. The sheet tray 8 is movable between a first position in which the sheet tray 8 is accommodated in the main casing 2 as shown in FIG. 1A and a second position as shown in FIG. 4 where the sheet tray 8 is positioned outside the main casing 2 and frontward of the first position.

As shown in FIG. 1A, a stack of first sheets P1 as an example of a first recording medium is accommodated in the sheet accommodation chamber 10. That is, the sheet accommodation chamber 10 is configured to receive the first sheets P1.

The sheet supply roller 9 is generally of a cylindrical shape extending in the right-left direction, and is positioned above a rear end portion of the sheet tray 8.

The sheet supply roller 9 is rotatably supported to the main casing 2.

(3) Image Forming Unit

The image forming unit 4 includes a scanner unit 11, a process unit 12, a transfer unit 13 and a fixing unit 14.

(3-1) Scanner Unit

The scanner unit 11 is positioned at an upper internal portion of the main casing 2. The scanner unit 11 is adapted to emit laser beams to a plurality of (four) photosensitive drums 18 (described later) on a basis of image data to expose surfaces of the photosensitive drums 18 to the laser beams.

(3-2) Process Unit

The process unit 12 is positioned at a vertically intermediate portion in the internal portion of the main casing 2, and below the scanner unit 11. More specifically, process unit 12 has a rear end portion positioned slightly higher than a vertically center portion of the main casing 2, and has a front end portion positioned slightly lower than the vertically center portion, such that the process unit 12 is inclined downward toward the front.

The process unit 12 includes a process frame 15 as an example of a moving member and four process cartridges 17 for four different colors as an example of cartridges. The process unit 12 is detachable from and attachable to the main casing 2 through the opening 6. More specifically, the process unit 12 is movable substantially in the front-rear direction between an internal position inside the main casing 2 as shown in FIG. 1A by a solid line, and an external position outside of the main casing 2 as shown by a two dotted chain line in FIG. 1A.

The process frame 15 is of a frame shape having generally a rectangular shape in side view. The process frame 15 is configured such that each of the plurality of process cartridges 17 can be attached to and detached from the process frame 15 when the process frame 15 is at the external position. Further, the process frame 15 is configured to support the plurality of process cartridges 17 such that the plurality of process cartridges 17 are positioned side by side with a space therebetween and are arrayed in the front-rear direction in the process frame 15.

For example, toners of black, yellow, magenta, and cyan are respectively accommodated in the plurality of process cartridges 17 in an order from front to rear cartridges. Each of the process cartridges 17 is provided with the photosensitive drum 18.

The photosensitive drum 18 is positioned at a lower end of the process cartridge 17, and is in the form of a generally cylindrical shape extending in the right-left direction. Further, the photosensitive drum 18 is rotatably supported to the process cartridge 17 and has a portion exposing outside from the lower end of the process cartridge 17. Incidentally, the process cartridge 17 also includes a developing roller (not shown) and a charger (not shown).

(3-3) Transfer Unit

The transfer unit 13 is positioned inside the main casing 2 and above the sheet supply unit 3 and below the process unit 12. The transfer unit 13 includes a drive roller 24, a first driven roller 23, a second driven roller 22, an intermediate transfer belt 25, and a secondary transfer roller 26.

The drive roller 24 is generally cylindrical shaped and extends in the right-left direction. The drive roller 24 is rotatably supported to the main casing 2 at a position rearward of the process unit 12.

The first driven roller 23 is generally cylindrical shaped and extends in the right-left direction. The first driven roller 23 is rotatably supported to the main casing 2 at a position below the front end portion of the process unit 12. More specifically, an imaginary line connecting between centers of the first driven roller 23 and the drive roller 24 provides an inclination coincident with the inclination of the process unit 12.

The second driven roller 22 is generally cylindrical shaped and extends in the right-left direction. The second driven roller 22 is rotatably supported to the main casing 2 at a position below the drive roller 24.

The intermediate transfer belt 25 is positioned below the respective photosensitive drums 18 such that an upper portion of the intermediate transfer belt 25 is in contact with the respective photosensitive drums 18. The intermediate transfer belt 25 is mounted over the drive roller 24, the first driven roller 23 and the second driven roller 22. Further, the intermediate transfer belt 25 is circulated by the rotations of the drive roller 24, the first driven roller 23 and the second driven roller 22 such that the upper portion of the intermediate transfer belt 25 is moved frontward.

The secondary transfer roller 26 is generally cylindrical shaped extending in the right-left direction, and is rotatably supported to the main casing 2 at a position opposite to the drive roller 24 with respect to the intermediate transfer belt 25. Further, the secondary transfer roller 26 is positioned at a rear side of the intermediate transfer belt 25 and diagonally above and rearward of the second driven roller 22. The secondary transfer roller 26 is in contact with the rear end portion of the intermediate transfer belt 25.

(3-4) Fixing Unit

The fixing unit 14 is positioned above the secondary transfer roller 26 and includes a heat roller 27 and a pressure roller 28 positioned diagonally above and rearward of the heat roller 27. Discharge rollers 29 and a discharge tray 30 are provided downstream of the fixing unit 14 in the sheet feeding direction.

2. Details of Sheet Supply Unit

As shown in FIGS. 1A through 3, the main casing 2 has an opening 20 formed in the front wall 5 and positioned below the front opening 6.

The sheet supply unit 3 includes the sheet tray 8, the sheet supply roller 9, and a rear guide member 21 as an example of a guide member.

(1) Sheet Tray

The sheet tray 8 can move through the opening 20 between a first position shown in FIG. 1A where the sheet tray 8 is mounted in the main casing 2, and a second position shown in FIG. 4 that is outside the main casing 2 and is forward of the first position. Thus, the sheet tray 8 can be withdrawn from the main casing 2 through the opening 20.

The sheet tray 8 includes a tray main body 50; a pivoting portion 57 as an example of a second receiving portion; and a front guide plate 58 as an example of a guide member.

(1-1) Tray Main Body

The tray main body 50 includes a rear plate 51, a bottom plate 52, a pair of side plates 53, and a front plate 54.

When the sheet tray 8 is in the first position inside the main casing 2, the rear plate 51 is disposed at a lower and rear internal portion of the main casing 2. The rear plate 51 has a shape of a flat plate extending in the left-right direction, and is substantially in a vertically-elongated rectangular shape in side view.

The bottom plate 52 has a shape of a flat plate extending in the left-right direction, and is substantially in a horizontally-elongated rectangular shape in side view. A rear end of the bottom plate 52 is continuous with a lower end of the rear plate 51.

The bottom plate 52 is provided with a first conveying roller 61. The first conveying roller 61 is disposed on the lower surface of the bottom plate 52 at a position slightly forward of the central portion of the bottom plate 52 in the front-rear direction. The first conveying roller 61 is generally of a cylindrical shape extending in the left-right direction. The first conveying roller 61 is rotatably supported to the bottom plate 52.

The pair of side plates 53 has a shape of a flat plate extending in the front-rear direction, and is substantially in a vertically-elongated rectangular shape in front view. One side plate 53 disposed on the left side is continuous with left ends of the rear plate 51 and of the bottom plate 52. The other side plate 53 that is disposed on the right side is continuous with right ends of the rear plate 51 and of the bottom plate 52.

The front plate 54 has a shape of a flat plate extending in the left-right direction, and is substantially in a vertically-elongated rectangular shape in side view. A left end of the front plate 54 is continuous with a front end of the left side plate 53, and a right end of the front plate 54 is continuous with a front end of the right side plate 53. A lower end of the front plate 54 is continuous with a front end of the bottom plate 52.

An opening 54*a* as an example of a first opening is formed in the lower central portion of the front plate 54. The opening 54*a* penetrates the front plate 54 in the front-rear direction. The opening 54*a* is elongated in the left-right direction. A second sheet P2, as an example of a second recording medium, can be supplied through the opening 54*a* into the main casing 2 as will be described later.

The sheet accommodation chamber 10 is partitioned by the rear plate 51, bottom plate 52, pair of side plates 53, and front plate 54.

(1-2) Pivoting Portion

The pivoting portion 57 is configured from: a pivoting plate 68 and a pair of support columns 55 as an example of a first fulcrum. The pivoting portion 57 and the front plate 54 having the opening 54*a* are disposed in the front end portion of the main casing 2 when the sheet tray 8 is mounted in the main casing 2, and cooperate to serve as an example of a supply portion for supplying the second sheet P2 into the main casing 2.

The pivoting portion 57 (pivoting plate 68) is configured to pivot around an axis of the support columns 55 as described later. The following description of each component is based on the situation where the pivoting portion 57 is at a fourth position shown in FIGS. 1A and 1B to be described later, that is, where the pivoting portion 57 is near the front plate 54.

The pivoting plate 68 has a shape of a flat plate extending in the left-right direction, and is substantially in a vertically-elongated rectangular shape in side view. The length of the pivoting plate 68 in the left-right direction (width of the pivoting plate 68) is substantially equal to the length of the front plate 54 in the left-right direction (width of the front plate 54). The pivoting plate 68 extends vertically along the front surface of the front plate 54 and is in contact with the front surface of the front plate 54.

The pair of support columns 55 are fixed to the lower end of the pivoting plate 68. The support columns 55 extend in the left-right direction. It can therefore be said that the pivoting plate 68 extends in a radial direction of the support columns 55. Each support column 55 is attached to the lower end of the front plate 54 so that the pivoting plate 68 can pivot about the axis of the support columns 55 relative to the front plate 54. Thus, the pivoting plate 68 can pivot relative to the tray main body 50.

When the pivoting portion 57 is at the fourth position and is placed along the front surface of the front plate 54 as shown in FIG. 1A, the lower part of the pivoting plate 68 closes the opening 54*a*. It can therefore be said that the fourth position is a position where the pivoting portion 57 closes the opening 54*a*.

A grip portion 59 is formed on the lower edge of the pivoting plate 68 at its center position in the left-right direction. The grip portion 59 is a concave that is recessed upwardly from the lower edge of the pivoting plate 68.

A slide groove 56 is formed on the rear surface of the pivoting plate 68 at its central position in the vertical direction. The slide groove 56 is a concave that is recessed forwardly from the rear surface of the pivoting plate 68. The slide groove 56 is elongated in the left-right direction.

A pair of regulation bodies 60 are slidably attached to the rear surface of the pivoting plate 68. Each regulation body 60 is substantially in an L-shape in planar view. Each regulation body 60 is oriented such that a base part of the L-shape extends in the left-right direction, and a protruding part of the L shape extends rearwardly from an outward end of the base part in the left-right direction. The base part of the L-shaped regulation body 60 is slidably fitted into the slide groove 56 such that the regulation body 60 can move in the left-right direction along the slide groove 56. The regulation bodies 60 are interlocked with each other such that when one regulation body 60 is moved outward in the left-right direction, the other regulation body 60 moves also outward in the left-right direction and when one regulation body 60 is moved inward in the left-right direction, the other regulation body 60 moves also inward in the left-right direction.

The front guide plate 58 is disposed below the front portion of the bottom plate 52. The front guide plate 58 has a shape of a flat plate extending in the front-rear direction, and is substantially in a horizontally-elongated rectangular shape in front view. A front end of the front guide plate 58 is continuous with the lower end of the front plate 54 at a position below the opening 54*a*. The front guide plate 58 extends rearward from the front plate 54 to a position near to a position below the center of the bottom plate 52 in the front-rear direction.

That is, when the front guide plate 58 is projected vertically, the length of the front guide plate 58 is substantially equal to the distance between the front end and the center of the sheet tray 8 in the front-rear direction.

The front guide plate 58 is provided with a first driven roller 62. The first driven roller 62 is disposed on the upper surface of the front guide plate 58 at a position slightly rearward of the center of the front guide plate 58 in the front-rear direction. The first driven roller 62 is generally of a cylindrical shape extending in the left-right direction. The first driven roller 62 is rotatably supported to the front guide plate 58. The first driven roller 62 is disposed below the first conveying roller 61, and is in contact with the lower end of the first conveying roller 61.

(1-3) First Sheet Path

The front guide plate 58 is disposed below and apart from the front portion of the bottom plate 52. More specifically, the front guide plate 58 and the front portion of the bottom plate 52 are placed parallel to each other and are spaced apart from each other in the vertical direction. The front guide plate 58 and the bottom plate 52 define therebetween a first sheet path 63*a* that extends in the front-rear direction. A front end of the first sheet path 63*a* is in communication with the opening 54*a*.

(2) Rear Guide Member

The rear guide member 21 includes a rear upper guide plate 41 and a rear lower guide plate 42. The rear upper guide plate 41 and rear lower guide plate 42 define a second sheet path 63*b* and a third sheet path 63*c* (to be described later) at a position below the rear portion of the sheet tray 8.

(2-1) Rear Upper Guide Plate

The rear upper guide plate 41 is disposed below the rear portion of the sheet tray 8. The rear upper guide plate 41 has a shape of a flat plate extending in the front-rear direction, and is substantially in a horizontally-elongated rectangular shape in front view. The rear upper guide plate 41 is fixed to the main casing 2 at such a position that when the sheet tray 8 is mounted in the main casing 2, a front end of the rear upper guide plate 41 is positioned near to the center of the bottom plate 52 in the front-rear direction and a rear end of the rear upper guide plate 41 is near to the rear end of the bottom plate 52.

The rear upper guide plate 41 is provided with a second conveying roller 64. The second conveying roller 64 is disposed on the lower surface of the rear upper guide plate 41 at a center of the rear upper guide plate 41 in the front-rear direction. The second conveying roller 64 is generally of a cylindrical shape extending in the left-right direction. The second conveying roller 64 is rotatably supported to the rear upper guide plate 41.

(2-2) Rear Lower Guide Plate

The rear lower guide plate 42 is fixed to the main casing 2. The rear lower guide plate 42 has a shape of a curved plate that is substantially in an L-shape in side view. More specifically, the rear lower guide plate 42 extends from a central portion of the main casing 2 in the front-rear direction rearwardly along the bottom surface of the main casing 2, and is bent upward toward a rear side before extending upward. The horizontally-extending, front part of the rear lower guide plate 42 is disposed below the rear upper guide plate 41 such that the front end of the rear lower guide plate 42 is disposed below the front end of the rear upper guide plate 41 and rearward of the rear end of the front guide plate 58 when the sheet tray 8 is mounted in the main casing 2. The curved, central part of the rear lower guide plate 42 goes around the lower-rear edge of the sheet tray 8. The vertically-extending, rear part of the rear lower guide plate 42 is disposed rearward of the sheet tray 8.

The rear lower guide plate 42 is provided with a second driven roller 65. The second driven roller 65 is disposed on the upper surface of the horizontally-extending part of the rear lower guide plate 42 at its center position in the front-rear direction. The second driven roller 65 is generally of a cylindrical shape extending in the left-right direction. The second driven roller 65 is rotatably supported to the rear lower guide plate 42.

The second driven roller 65 is disposed below the second conveying roller 64 and is in contact with the lower end of the second conveying roller 64.

(2-3) Second Sheet Path

The rear upper guide plate 41 and the horizontally-extending part of the rear lower guide plate 42 are disposed parallel to each other and are spaced apart from each other in the vertical direction. The rear upper guide plate 41 and the horizontally-extending part of the rear lower guide plate 42 define therebetween the second sheet path 63*b* that extends in the front-rear direction. The front end of the second sheet path 63*b* is in communication with the rear end of the first sheet path 63*a*.

(2-4) Third Sheet Path

The vertically-extending part of the rear lower guide plate 42 is disposed apart from the sheet tray 8 in the front-rear direction. More specifically, the vertically-extending part of the rear lower guide plate 42, and the rear plate 51 of the sheet tray 8 are placed parallel to each other and are spaced apart from each other in the front-rear direction. The vertically-extending part of the rear lower guide plate 42, and the rear plate 51 define therebetween the third sheet path 63*c* that extends vertically. The lower end of the third sheet path 63*c* is in communication with the rear end of the second sheet path 63*b*. Thus, the first sheet path 63*a*, second sheet path 63*b*, and third sheet path 63*c* constitute a conveying path along which the second sheet P2 which has been supplied through the opening 54*a* is conveyed toward the transfer unit 13.

The front guide plate 58, first conveying roller 61, first driven roller 62, rear upper guide plate 41, rear lower guide plate 42, second conveying roller 64, and second driven roller 65 constitute a conveying mechanism for conveying the second sheet P2.

3. Movement of Sheet Tray Between First and Second Positions

Next will be described how the sheet tray 8 is moved between the first position and the second position. It is noted that a user operates each component in the sheet tray 8 when moving the sheet tray 8 between the first position and the second position.

Figure 1B:
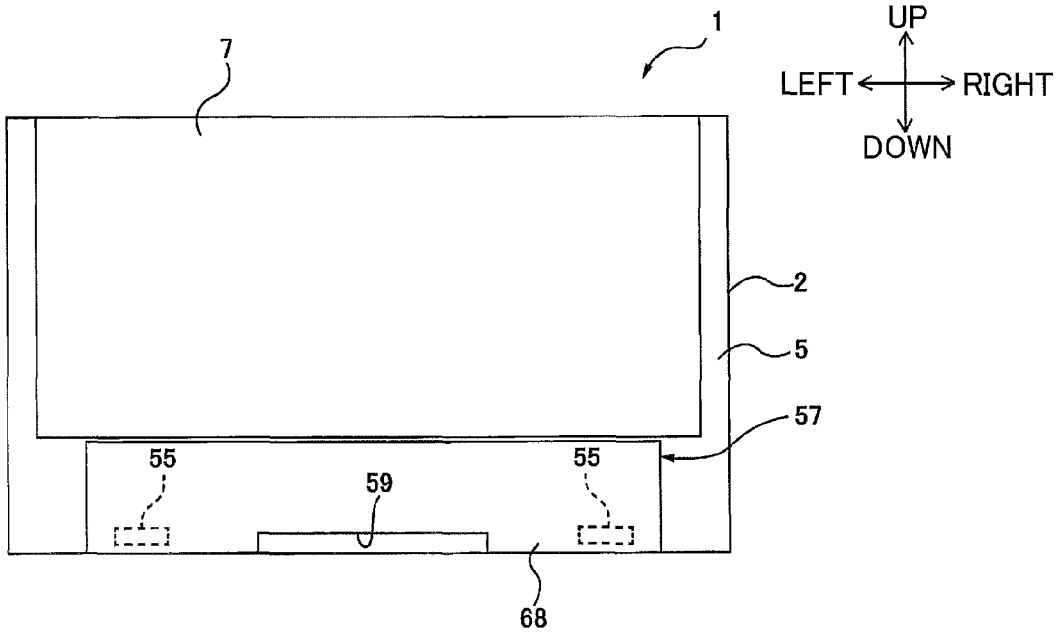
FIG. 1B is a front view of the printer shown in FIG. 1A.

First, in the situation shown in FIGS. 1A and 1B, the sheet tray 8 is at the first position and a first sheet P1 can be conveyed from the sheet tray 8.

The sheet tray 8 is moved slidingly forward to the second position shown in FIG. 4. At this time, the tray main body 50, the pivoting portion 57, and the front guide plate 58 move as one integral unit. In this manner, the sheet tray 8 moves from the first position shown in FIG. 1A to the second position shown in FIG. 4 that is outside the main casing 2 and is forward of the first position.

When the sheet tray 8 is thus at the second position, a stack of first sheets P1 can be placed in the sheet accommodation chamber 10.

When the sheet tray 8 is moved slidingly from the second position rearward until the entire part of the sheet tray 8 is inside the main casing 2, the sheet tray 8 reaches the first position as shown in FIGS. 1A and 1B.

4. Pivoting Operation of Pivoting Portion and Conveying of Second Sheet

Next will be described how the pivoting portion 57 is pivoted. It is noted that a user operates each component in the sheet tray 8 when pivoting the pivoting portion 57.

In the situation shown in FIGS. 1A and 1B, the pivoting portion 57 is at the fourth position, and the opening 54*a* is closed by the pivoting portion 57.

Figure 2A:
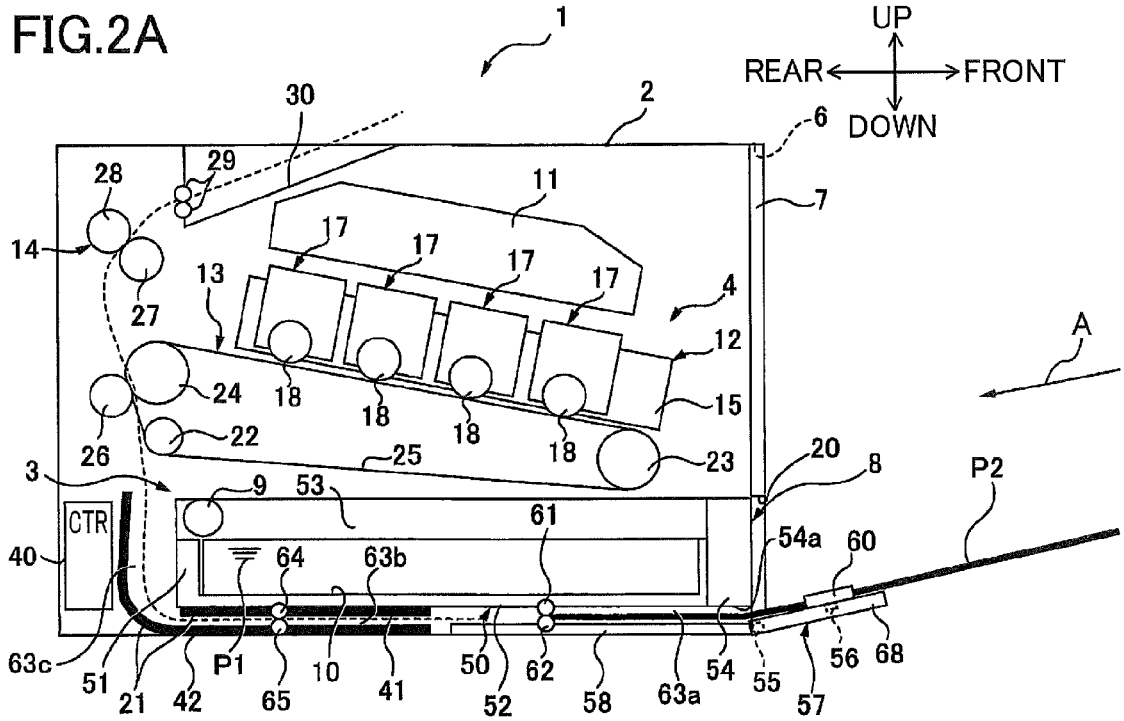
FIG. 2A is a cross-sectional view of the printer according to the first embodiment, the cross-sectional view being taken along the widthwise center line of the printer and showing an open state of the pivoting portion.
Figure 2B:
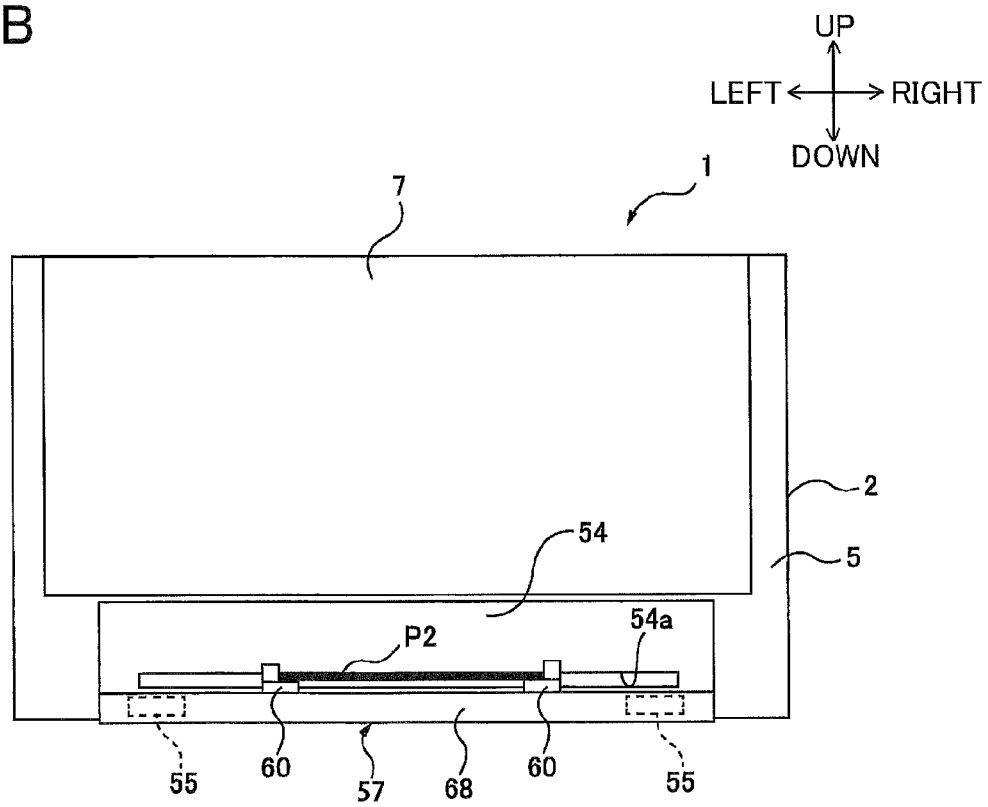
FIG. 2B is a front view of the printer as viewed in a direction indicated by an arrow A in FIG. 2A.
Figure 3:
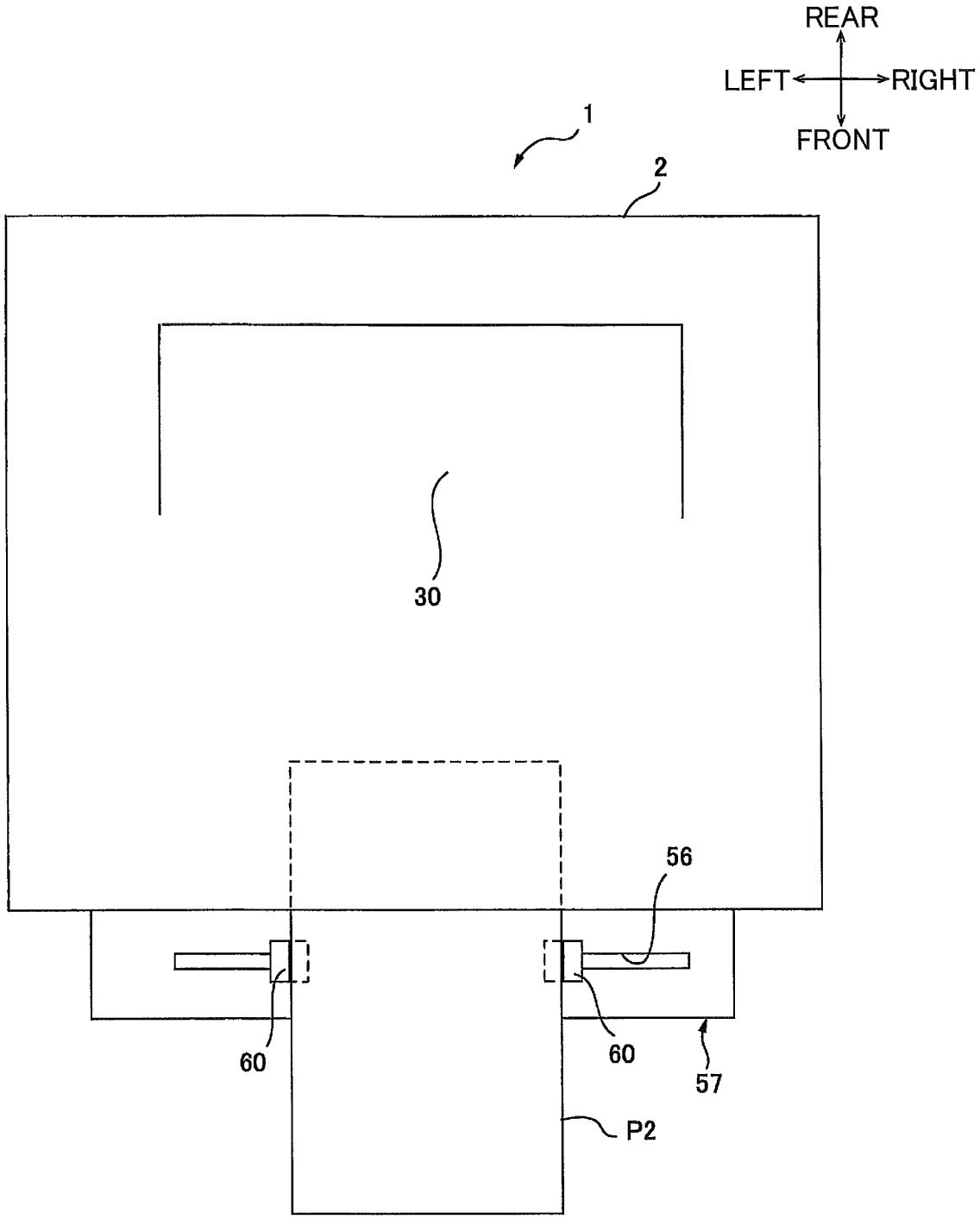
FIG. 3 is a plan view of the printer shown in FIGS. 2A and 2B.

In order to set a second sheet P2 in the printer 1, the pivoting plate 68 is pivoted around the support columns 55 toward the front side (clockwise in FIGS. 1A and 2A). As a result, as shown in FIGS. 2A, 2B, and 3, the pivoting plate 68 is oriented along a plane that extends almost in the front-rear direction. At this time, the pivoting portion 57 is at the third position whose vertical level is lower than the fourth position, and opens the opening 54*a*. That is, the third position is a position of the pivoting portion 57 where the pivoting portion 57 opens the opening 54*a*.

In this state, the second sheet P2 is inserted into the main casing 2 through the opening 54*a*. The second sheet P2 is inserted into the main casing 2 until the second sheet P2 reaches a position where a rear edge of the second sheet P2 comes in contact with the first conveying roller 61 and the first driven roller 62. In this manner, the second sheet P2 is placed on the pivoting plate 68 and the front guide plate 58, and becomes ready to be conveyed. The second sheet P2 is restricted from moving in the left-right direction by the regulation bodies 60.

5. Printing Operation in Printer

The printing operation is carried out under control by the controller 40.

First, printing operation on the first sheet P1 will be described. As shown in FIGS. 1A and 1B, the controller 40 controls the sheet supply roller 9 for feeding the first sheet P1 accommodated in the sheet accommodation chamber 10 of the sheet tray 8 so as to convey the sheet P1 such that a rear edge (FIG. 1A) of the sheet P1 moves upwardly as the leading end in the sheet conveying direction and a front edge (FIG. 1A) of the sheet P1 moves rearwardly as the trailing end in the sheet conveying direction. The controller 40 also controls a feed roller (not shown) so as to direct the first sheet P1 to a location between the secondary transfer roller 26 and the intermediate transfer belt 25.

In each process cartridge 17, toner is supplied to the developing roller (not shown) and is carried on the developing roller in the form of a thin toner layer in accordance with the rotation of the developing roller while being charged with positive polarity upon triboelectric charging.

On the other hand, in accordance with the rotation of the photosensitive drum 18, the surface of the photosensitive drum 18 is uniformly charged with positive polarity by the charger (not shown), before being exposed to a high speed scanning of a laser beam emitted from the scanner unit 11. Thus, an electrostatic latent image is formed on the surface based on image data indicative of an image to be formed on the first sheet P1.

The toner carried on the surface of the developing roller and charged with positive polarity is supplied to the electrostatic latent image formed on the surface of the photosensitive drum 18 in accordance with further rotation of the photosensitive drum 18. Thus, a toner image is formed on the surface of the photosensitive drum 18 through a reverse development process.

Toner images thus carried on the photosensitive drums 18 of the process cartridges 17 are successively transferred onto the upper portion of the intermediate transfer belt 25 that is moved frontward. As a result, a multicolor toner image is formed on the surface of the intermediate transfer belt 25 (primary image transfer).

Then the controller 40 controls the secondary transfer roller 26 so as to transfer the multicolor toner image on the intermediate transfer belt 25 onto the first sheet P1 (secondary image transfer) when the first sheet P1 supplied from the sheet tray 8 moves between the intermediate transfer belt 25 and the secondary transfer roller 26.

Then the controller 40 controls the heat roller 27 and the pressure roller 28 so as to thermally fix the multicolor toner image onto the first sheet P1 when the first sheet P1 moves between the heat roller 27 and the pressure roller 28.

Then the controller 40 controls the discharge rollers 29 so as to direct the first sheet P1 diagonally frontward and upward along a U-turn path and discharge the first sheet P1 onto the discharge tray 30.

Printing operation on the second sheet P2 will next be described.

As shown in FIGS. 2A, 2B, and 3, the controller 40 performs a control operation to convey, to the transfer unit 13, the second sheet P2 that has been supplied through the opening 20 into the main casing 2 by the pivoting portion 57.

More specifically, the controller 40 controls the first conveying roller 61, first driven roller 62, second conveying roller 64, and second driven roller 65 to convey the second sheet P2 to a position between the intermediate transfer belt 25 and the secondary transfer roller 26 such that the rear edge of the second sheet P2 is the leading end in the conveying direction.

Then, as in the case of forming an image on the first sheet P1, the controller 40 performs a control such that a multicolor toner image is transferred from the intermediate transfer belt 25 onto the second sheet P2 when the second sheet P2 passes between the intermediate transfer belt 25 and the secondary transfer roller 26 (secondary transfer). The controller 40 performs a control such that the multicolor toner image that has been transferred onto the second sheet P2 is thermally fixed by the fixing unit 14 and the second sheet P2 is discharged onto the sheet discharge tray 30 after passing between the sheet discharge rollers 29.

6. Operations (1) In the printer 1, as shown in FIG. 1A, the front guide plate 58, rear upper guide plate 41, and rear lower guide plate 42 are disposed below the sheet accommodation chamber 10. Therefore, the conveying path of the second sheet P2, which is made up from the first through third sheet paths 63*a*, 63*b*, and 63*c*, has a small curvature, thereby preventing the conveyed second sheet P2 from being bent excessively.

(2) In the printer 1, as shown in FIGS. 1A, 1B, and 4, the sheet tray 8 can be moved through the opening 20 between the first position, at which the sheet tray 8 is inside the main casing 2, and the second position, at which the sheet tray 8 is outside the main casing 2. The process unit 12 can be attached to, and detached from, the main casing 2 through the opening 6. Therefore, a user can work in front of the printer 1 when moving the sheet tray 8 between the first and second positions, and also when attaching or detaching the process unit 12 to or from the main casing 2. The user can therefore easily move the sheet tray 8 and attach and detach the process unit 12.

(3) In the printer 1, as shown in FIGS. 2A and 2B, the opening 54*a* is formed in the front plate 54 of the sheet tray 8. Therefore, the user can work in front of the printer 1 when supplying the second sheet P2 into the opening 54*a*. The user can therefore easily supply sheets to the printer 1.

(4) In the printer 1, as shown in FIGS. 1A-3, the pivoting portion 57 can be moved between the third and fourth positions, without moving the sheet tray 8. Therefore, a user can easily supply the second sheet P2 in the main casing 2 by simply moving the pivoting portion 57 from the fourth position to the third position.

(5) In the printer 1, as shown in FIGS. 1A-3, the opening 54*a* can be opened or closed by simply opening or closing the pivoting portion 57 between the third position and the fourth position. Therefore, a user can easily open and close the opening 54*a*.

(6) In the printer 1, as shown in FIGS. 1A-2B, the pivoting portion 57 can be moved between the third and fourth positions by simply pivoting the pivoting plate 68. Therefore, a user can easily move the pivoting portion 57 between the third and fourth positions.

(7) More specifically, as shown in FIGS. 1A-2B, the pivoting portion 57 can be moved between the third and fourth positions by simply pivoting the pivoting plate 68 around the support columns 55.

(8) In the printer 1, as shown in FIG. 3, the pivoting portion 57 is provided with the pair of regulation bodies 60 that can move in the left-right direction. When the second sheet P2 is placed on the pivoting plate 68 and is conveyed along the pivoting plate 68, the regulation bodies 60 restrict the second sheet P2 from moving in the left-right direction. Thus, the second sheet P2 can be conveyed smoothly.

(9) In the printer 1, as shown in FIG. 4, by moving the sheet tray 8 from the first position to the second position, the front guide plate 58 can be moved forward, while the rear upper guide plate 41 and the rear lower guide plate 42 remain disposed in the main casing 2. Therefore, when a sheet becomes jammed in the main casing 2, a user can easily work on the main casing 2 by withdrawing the sheet tray 8 out of the main casing 2.

(10) In the printer 1, as shown in FIGS. 1A, 1B, and 4, the front guide plate 58 extends from the front side of the main casing 2 to the position near to the center of the main casing 2 in the front-rear direction, while the rear upper guide plate 41 and rear lower guide plate 42 extend from the rear side of the main casing 2 to a position near to the center of the main casing 2 in the front-rear direction. Therefore, the front guide plate 58, rear upper guide plate 41, and rear lower guide plate 42 are disposed below the sheet tray 8 in a well-balanced manner, and can convey the second sheet P2 smoothly. When a sheet becomes jammed, a user can easily work on the main casing 2 by withdrawing the sheet tray 8 out of the main casing 2.

7. Second Embodiment

Hereinafter, a printer 101 according to a second embodiment will be described with reference to FIGS. 5A and 5B. In the following description, the same or like components as those in the first embodiment are represented by the same reference numerals, and description thereof will be omitted.

According to the first embodiment, the opening 54*a* is opened and closed by pivoting the pivoting portion 57 (pivoting plate 68). However, the opening 54*a* may be always open. In the second embodiment, the opening 54*a* is always open.

The printer 101 of the second embodiment is the same as the printer 1 of the first embodiment except that the printer 101 employs a sheet tray 108 in place of the sheet tray 8. The sheet tray 108 is different from the sheet tray 8 in that the sheet tray 108 is provided with no pivoting portion 57. Instead, as shown in FIGS. 5A and 5B, the sheet tray 108 is formed with a grip handle 70. The grip handle 70 is located on the front surface of the front plate 54 at an upper portion thereof.

The grip handle 70 is substantially in an L-shape in side view. The grip handle 70 protrudes forward from the upper portion of the front surface of the front plate 54, and is then bent downward.

A pair of regulation bodies 71 having similar configurations with the regulation bodies 60 in the first embodiment are slidably fitted to the opening 54*a*.

More specifically, the pair of regulation bodies 71 are slidably attached to the front surface of the front plate 54. Each regulation body 71 is substantially in an L-shape in front view. Each regulation body 71 is oriented such that a base part of the L-shape extends in the left-right direction, and a protruding part of the L shape extends upwardly from an outward end of the base part in the left-right direction. As shown in FIG. 5A, a rear part of the regulation body 71 is slidably fitted into the opening 54*a* such that the regulation body 71 can move in the left-right direction along the opening 54*a*. The regulation bodies 71 are interlocked with each other such that when one regulation body 71 is moved outward in the left-right direction, the other regulation body 71 moves also outward in the left-right direction and when one regulation body 71 is moved inward in the left-right direction, the other regulation body 71 moves also inward in the left-right direction.

In order to set a second sheet P2 in the printer 101, a user moves the regulation bodies 71 in the left-right direction to adjust the distance between the regulation bodies 71 to a size slightly wider than the width of the second sheet P2. The user then inserts the second sheet P2 into the opening 54*a* until the second sheet P2 reaches a position where a rear edge of the second sheet P2 comes in contact with the first conveying roller 61 and the first driven roller 62. In this manner, the second sheet P2 is placed on the front guide plate 58. Then, the user moves the regulation bodies 71 in the left-right direction to adjust the distance between the regulation bodies 71 to a size substantially equal to the width of the second sheet P2 so that the lower surface of the second sheet P2 is supported on the base parts of the L-shaped regulation bodies 71 and the outer edges of the second sheet P2 in the left-right direction are in contact with the inner side surfaces of the protruding parts of the L-shaped regulation bodies 71 in the left-right direction. In this manner, the regulation bodies 71 restrict the second sheet P2 from moving in the left-right direction. Thus, the second sheet P2 is ready to be conveyed by the first conveying roller 61 and first driven roller 62.

Thereafter, the second sheet P2 is conveyed to the transfer unit 13 similarly as in the first embodiment.

In order to place a stack of first sheets P1 in the sheet accommodation chamber 10, a user holds the grip handle 70 and slides the sheet tray 108 forward. As a result, the sheet tray 108 is moved to the second position which is outside the main casing 2 and is forward of the first position.

Figure 5A:
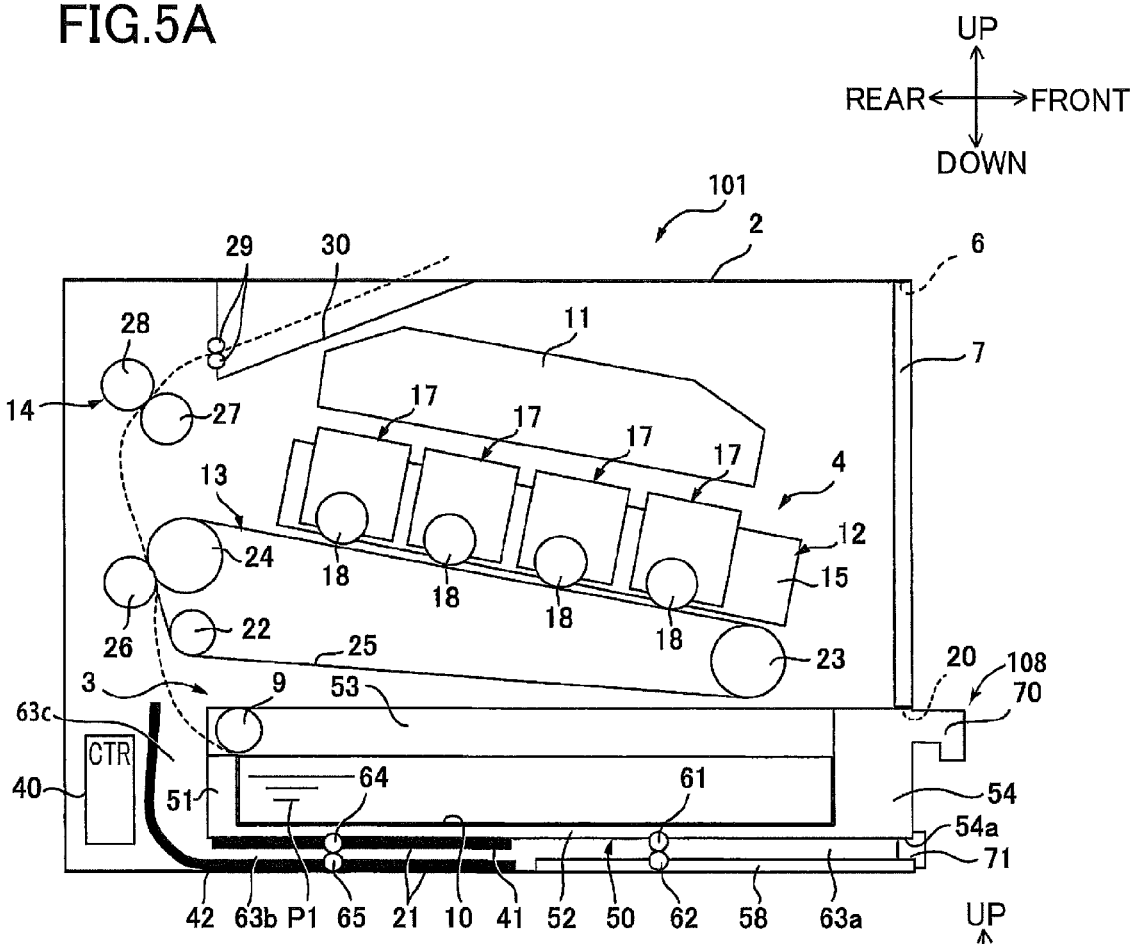
FIG. 5A is a cross-sectional view of a printer as an example of an image forming apparatus according to a second embodiment of the present invention, the cross-sectional view being taken along a widthwise center line of the printer.
Figure 5B:
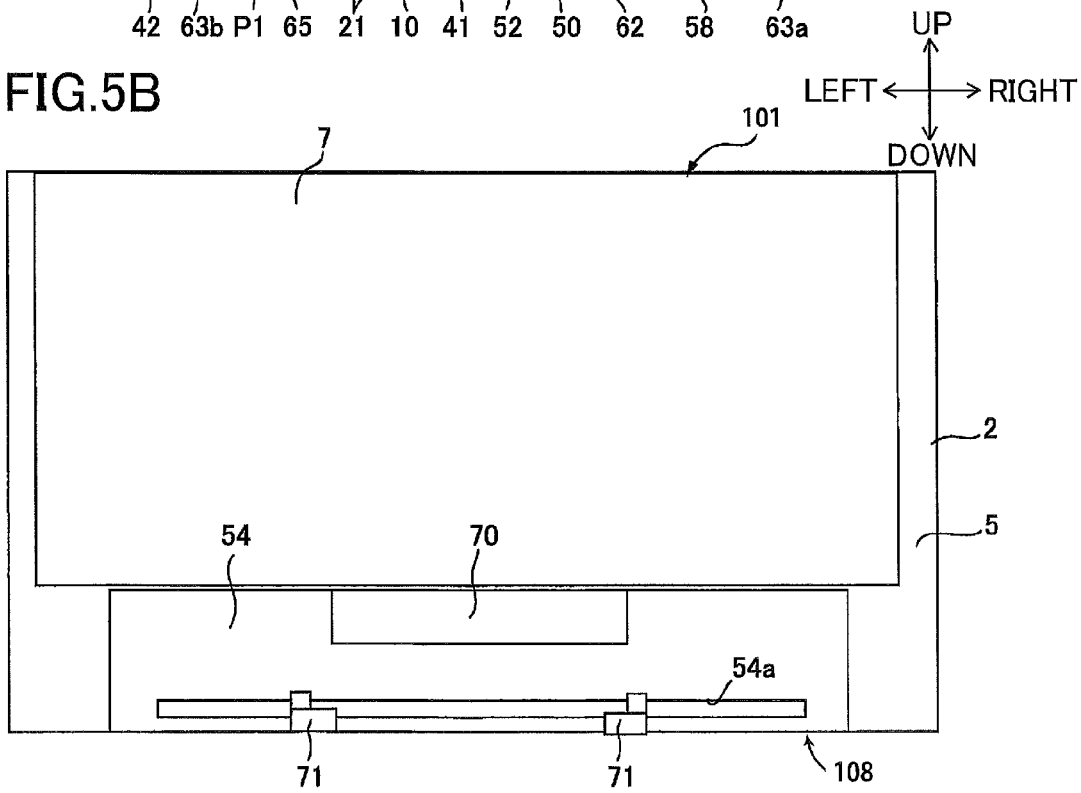
FIG. 5B is a front view of the printer shown in FIG. 5A.

In the printer 101 of the second embodiment, as shown in FIGS. 5A and 5B, the opening 54*a* is always open. Therefore, a user can easily supply the second sheet P2 into the main casing 2 through the opening 54*a*. Moreover, when a sheet becomes jammed, the user can easily work on the main casing 2 by withdrawing the sheet tray 108 out of the main casing 2.

8. Third Embodiment

A printer 201 according to a third embodiment will be described later with reference to FIGS. 6A-7. In the following description, the same or like components as those in the second embodiment are represented by the same reference numerals, and description thereof will be omitted.

In the second embodiment, the front guide plate 58 is provided on the sheet tray 108, similarly to the first embodiment in which the front guide plate 58 is provided on the sheet tray 8. However, the front guide plate 58 may be provided to the main casing 2. In other words, all of the guide members for guiding the second sheet P2 may be fixed to the main casing 2.

The printer 201 of the third embodiment is the same as the printer 101 of the second embodiment except that the printer 201 employs a sheet tray 208 in place of the sheet tray 108 and that the printer 201 has a main casing 202, to which all the guide members for guiding the second sheet P2 are fixed.

Figure 6A:
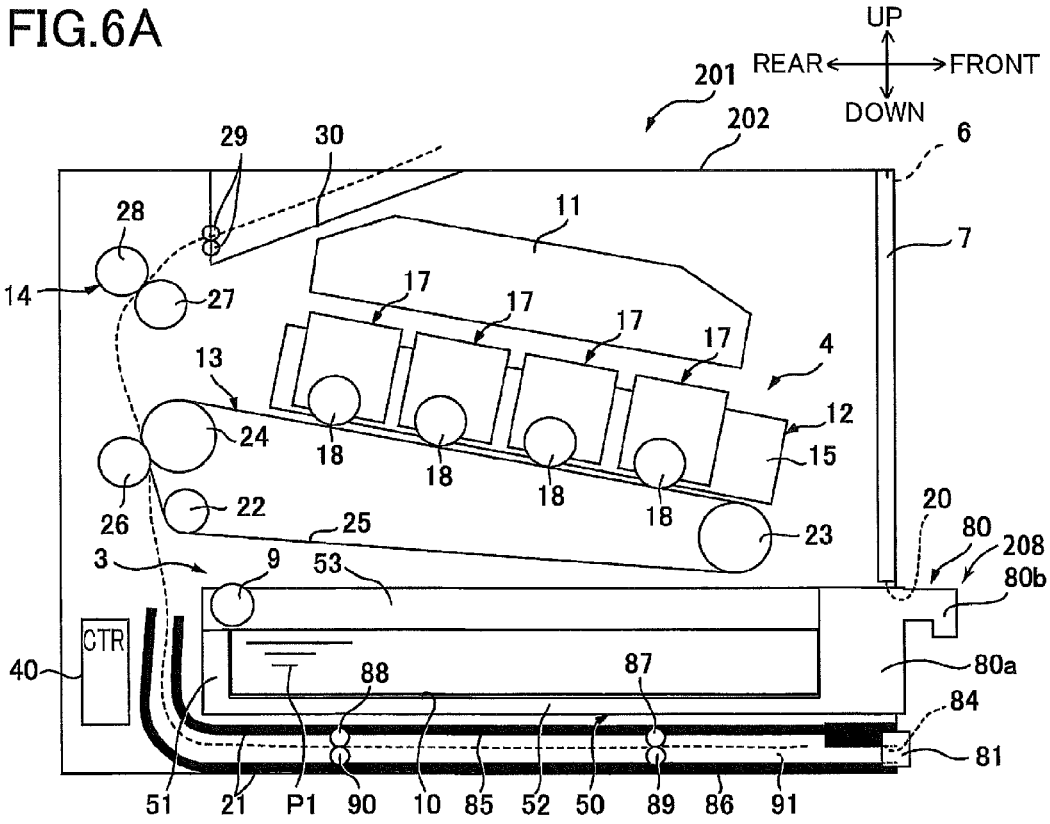
FIG. 6A is a cross-sectional view of a printer as an example of an image forming apparatus according to a third embodiment of the present invention, the cross-sectional view being taken along a widthwise center line of the printer.
Figure 6B:
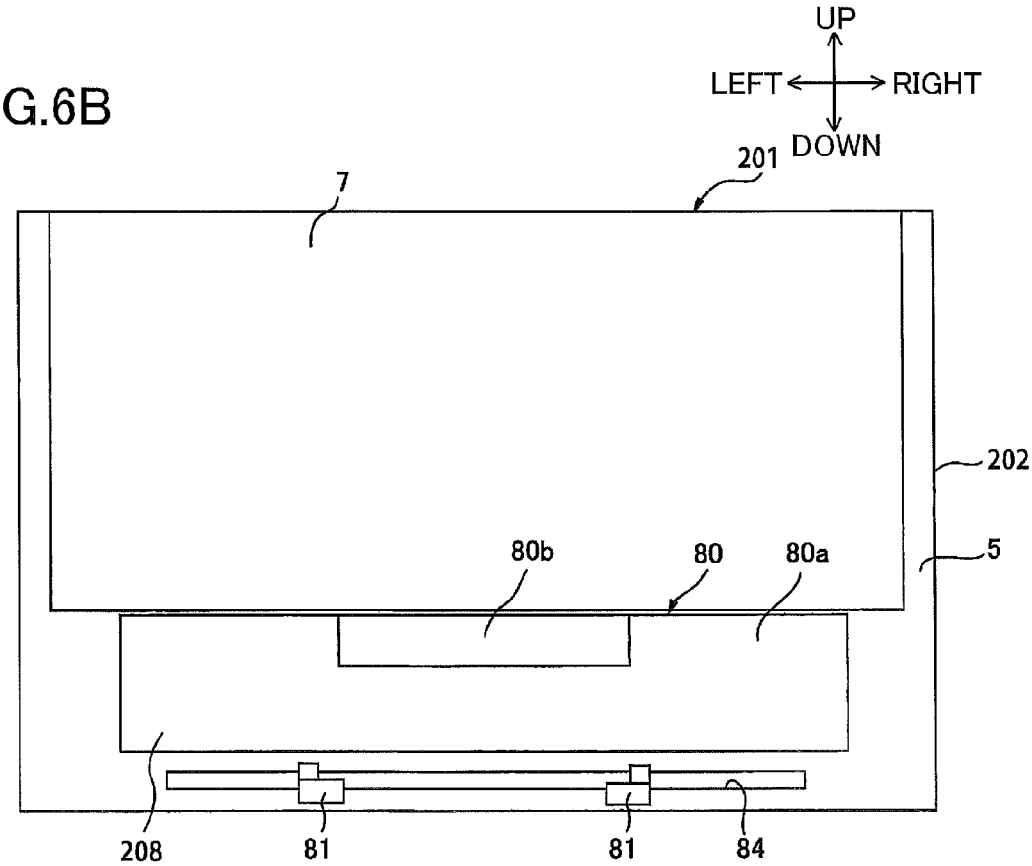
FIG. 6B is a front view of the printer shown in FIG. 6A.
Figure 7:
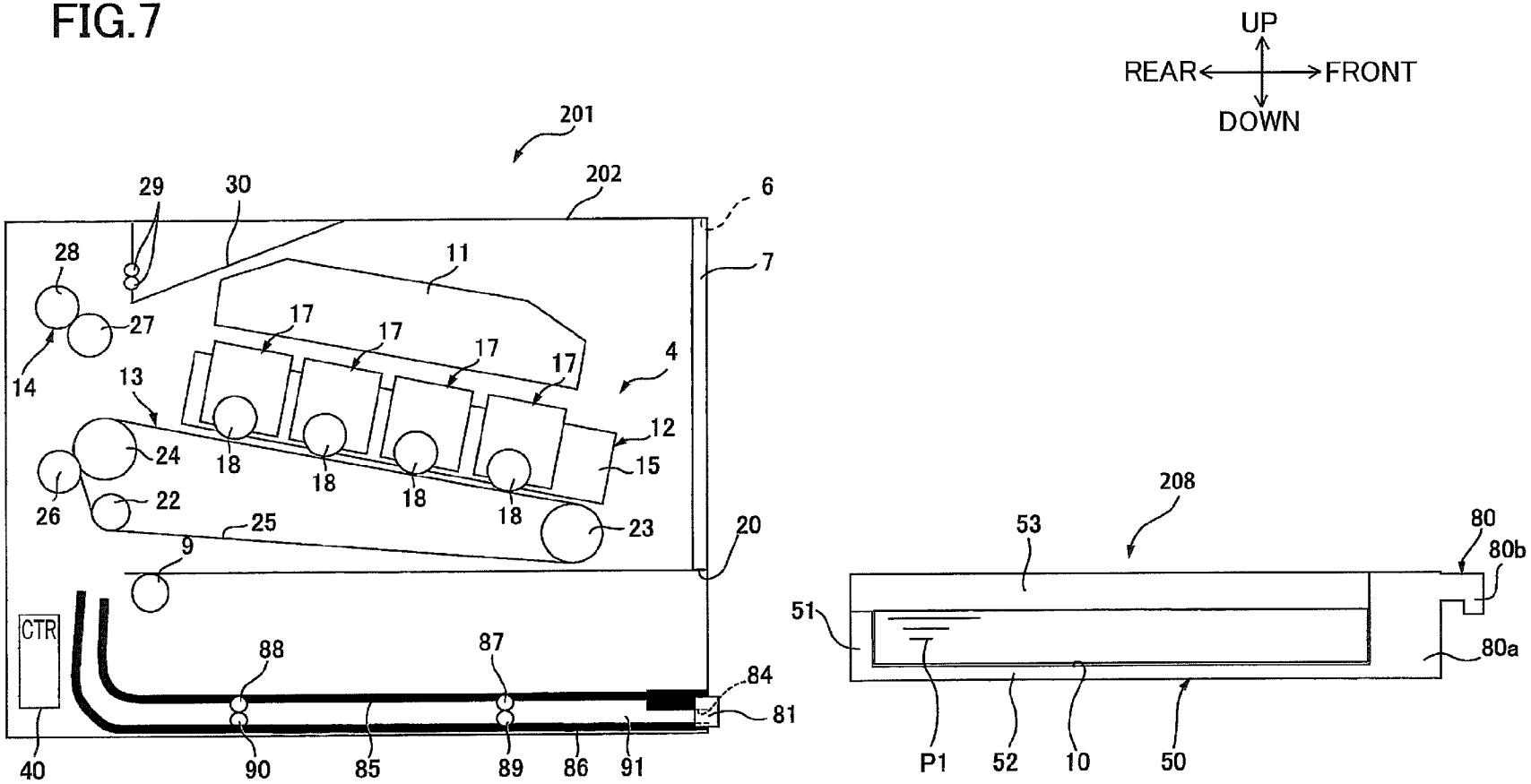
FIG. 7 is a cross-sectional view of the printer according to the third embodiment, and showing a withdrawn state of a sheet tray, the cross-sectional view being taken along a widthwise center line of the printer.

As shown in FIGS. 6A and 6B, the sheet tray 208 according to the third embodiment is different from the sheet tray 108 in the second embodiment in that the sheet tray 208 includes a grip member 80 in place of the front plate 54 and the grip handle 70 in the second embodiment.

The grip member 80 includes a front plate 80*a* and a grip handle 80*b*. The front plate 80*a* has a shape of a plate that extends in the left-right direction, and is substantially in a vertically-elongated rectangular shape in side view. The front plate 80*a* has a relatively large size in the front-rear direction (thickness). A left end of the front plate 80*a* is continuous with a front end of the left side plate 53, while a right end of the front plate 80*a* is continuous with a front end of the right side plate 53, and a lower end of the front plate 80*a* is continuous with a front end of the bottom plate 52.

The grip handle 80*b* is substantially in an L-shape in side view, and protrudes forward from an upper portion of the front surface of the front plate 80*a*, and is then bent downward.

The sheet tray 208 according to the third embodiment is formed with no opening 54*a*. Instead, a main casing 202 of the printer 201 according the third embodiment is formed with an opening 84, as an example of a first opening. The opening 84 is formed in the lower end portion of the front wall 5 of the main casing 202. The opening 84 is elongated in the left-right direction.

A pair of regulation bodies 81 having the same configuration with the regulation bodies 71 in the second embodiment are slidably fitted to the opening 54*a* in the same manner as the regulation bodies 71 in the second embodiment.

An upper guide plate 85 and a lower guide plate 86 are provided, as an example of a guide member, at a lower internal portion of the main casing 202 at such a position that the upper guide plate 85 and the lower guide plate 86 are positioned below the sheet tray 208 when the sheet tray 208 is mounted in the main casing 202.

The upper guide plate 85 is located below the sheet tray 208, and has a shape of a curved plate that is substantially in an L-shape in side view. A front end of the upper guide plate 85 is continuous with the front wall 5 at a position above the opening 84. The upper guide plate 85 extends rearwardly from the front wall 5, and is bent upward toward the rear side before extending upward. The upwardly-extending, rear part of the upper guide plate 85 is positioned rearward of the sheet tray 208, with a gap being formed between the upwardly-extending rear part of the upper guide plate 85 and the rear plate 51 of the sheet tray 208 in the front-rear direction.

The upper guide plate 85 is provided with a first conveying roller 87 and a second conveying roller 88.

The first conveying roller 87 is disposed on the lower surface of the upper guide plate 85 at a position slightly forward of the center of the upper guide plate 85 in the front-rear direction. The second conveying roller 88 is disposed on the lower surface of the upper guide plate 85 at a position slightly rearward of the center of the upper guide plate 85 in the front-rear direction. Each of the first and second conveying rollers 87 and 88 is generally of a cylindrical shape extending in the left-right direction. The first and second conveying rollers 87 and 88 are rotatably supported to the upper guide plate 85.

The lower guide plate 86 is located below the upper guide plate 85, and has a shape of a curved plate that is substantially in an L-shape in side view. A front end of the lower guide plate 86 is continuous with the front wall 5 at a position below the opening 84. The lower guide plate 86 extends rearwardly from the front wall 5, and is bent upward toward the rear side before extending upward. The upwardly-extending, rear part of the lower guide plate 86 is positioned rearward of the upwardly-extending rear part of the upper guide plate 85, with a gap being formed therebetween.

The horizontally-extending front parts of the upper guide plate 85 and the lower guide plate 86 are placed parallel to each other and are spaced apart from each other in the vertical direction. The upwardly-extending rear parts of the upper guide plate 85 and the lower guide plate 86 are placed parallel to each other and are spaced apart from each other in the front-rear direction.

The upper guide plate 85 and the lower guide plate 86 define therebetween a sheet path 91 which extends from the opening 84 rearwardly in the lower internal portion of the main casing 202, and is bent upward to the rear before extending upward.

The lower guide plate 86 is provided with a first driven roller 89 and a second driven roller 90.

The first driven roller 89 is disposed on the upper surface of the horizontally-extending front part of the lower guide plate 86 at a position slightly forward of the center of the horizontally-extending front part in the front-rear direction. The second driven roller 90 is disposed on the upper surface of the horizontally-extending front part of the lower guide plate 86 at a position slightly rearward of the center of the horizontally-extending front part in the front-rear direction. Each of the first and second driven rollers 89 and 90 is generally of a cylindrical shape extending in the left-right direction. Each of the first and second driven rollers 89 and 90 is rotatably supported to the lower guide plate 86. The first driven roller 89 is located below the first conveying roller 87, and is in contact with the lower end of the first conveying roller 87. The second driven roller 90 is located below the second conveying roller 88, and is in contact with the lower end of the second conveying roller 88.

In order to set a second sheet P2 in the printer 201, a user inserts the second sheet P2 in the opening 84 and moves the regulation bodies 81 in the same manner as in the second embodiment so that the rear edge of the second sheet P2 contacts the first conveying roller 87 and the first driven roller 89. In this way, the second sheet P2 becomes ready to be conveyed. Thereafter, the second sheet P2 is conveyed to the transfer unit 13 in the same manner as in the second embodiment.

In order to place a stack of first sheets P1 in the sheet accommodation chamber 10, a user holds the grip handle 80*b* and slides the sheet tray 208 forward. As a result, as shown in FIG. 7, the sheet tray 208 moves to the second position which is outside the main casing 202 and is forward of the first position. In this state, the user places the first sheets P1 in the sheet accommodation chamber 10.

In the printer 201 of the third embodiment, as shown in FIG. 6B, the opening 84 is always open. Therefore, the user can easily supply the second sheet P2 into the main casing 202 through the opening 84.

While the invention has been described in detail with reference to the embodiments thereof, it would be apparent to those skilled in the art that various changes and modifications may be made therein without departing from the spirit of the invention.

What is claimed is:

1. An image forming apparatus comprising:

an apparatus body;

a process unit having a photosensitive body extending in a first direction;

a tray having a first receiving portion configured to receive a first recording medium, the tray being configured to move between a first position inside the apparatus body and a second position outside the apparatus body, a second direction being defined as a direction that intersects both of a vertical direction and the first direction and is directed from the second position to the first position, the tray being configured to allow the first recording medium to be conveyed from the first receiving portion when the tray is positioned in the first position;

a supply part that has a first opening, the supply part being configured to allow a second recording medium different from the first recording medium to be conveyed through the first opening; and a conveying mechanism configured to convey, in the second direction, the second recording medium supplied from the supply part, the conveying mechanism including a guide member disposed below the first receiving portion and configured to guide the second recording medium, wherein:

the tray has a first tray end and a second tray end opposite to each other in the second direction, the second tray end being in an upstream side relative to the first tray end in the second direction, and the supply part is provided at the second tray end of the tray.

2. The image forming apparatus according to claim 1, wherein the tray is further provided with a second receiving portion that is configured to receive a second recording medium, the second receiving portion being configured to move between a third position, which is at an upstream side relative to the first opening in the second direction, and a fourth position, which is at a downstream side relative to the third position in the second direction.

3. The image forming apparatus according to claim 2, wherein the second receiving portion is configured to open the first opening when the second receiving portion is in the third position, and to close the first opening when the second receiving portion is in the fourth position.

4. The image forming apparatus according to claim 2, wherein the second receiving portion is configured to move between the third position and the fourth position by pivoting about an axis that extends in the first direction.

5. The image forming apparatus according to claim 4, wherein the second receiving portion includes:

a first fulcrum extending in the first direction; and a plate part that is plate-shaped and that extends in a radial direction of the first fulcrum, the plate part being configured to pivot about the first fulcrum.

6. The image forming apparatus according to claim 2, wherein the second receiving portion is provided with a restricting portion configured to restrict the second recording medium, which is being received in the second receiving portion, from moving in the first direction and a direction opposite to the first direction.

7. An image forming apparatus comprising:

an apparatus body;

a process unit having a photosensitive body extending in a first direction;

a tray having a first receiving portion configured to receive a first recording medium, the tray being configured to move between a first position inside the apparatus body and a second position outside the apparatus body, a second direction being defined as a direction that intersects both of a vertical direction and the first direction and is directed from the second position to the first position, the tray being configured to allow the first recording medium to be conveyed from the first receiving portion when the tray is positioned in the first position;

a supply part that has a first opening, the supply part being configured to allow a second recording medium different from the first recording medium to be conveyed through the first opening; and a conveying mechanism configured to convey, in the second direction, the second recording medium supplied from the supply part, the conveying mechanism including a guide member disposed below the first receiving portion and configured to guide the second recording medium, wherein the conveying mechanism includes:

a first part provided to the tray; and a second part provided to the apparatus body.

8. The image forming apparatus according to claim 7, wherein:

the tray has a first tray end and a second tray end opposite to each other in the second direction, the second tray end being at an upstream side relative to the first tray end in the second direction, and a length, defined in the second direction, of the first part of the conveying mechanism, is substantially equal to a distance between the second tray end of the tray and a center, defined in the second direction, of the tray, assuming that the tray positioned in the first position is projected vertically to the apparatus body.

9. The image forming apparatus according to claim 1, wherein:

the apparatus body has a first apparatus-body side and a second apparatus-body side opposite to each other in the second direction, the second apparatus-body side being at an upstream side relative to the first apparatus-body side in the second direction, and the apparatus body has a second opening at the second apparatus-body side of the apparatus body, the process unit being configured to move through the second opening between an internal position defined inside the apparatus body and an external position defined outside of the apparatus body.

10. The image forming apparatus according to claim 9, wherein the process unit comprises:

a plurality of cartridges; and a moving member configured to move through the second opening between the internal position and the external position and configured to allow the cartridges to be attached to and detached from the moving member when the moving member is positioned at the external position.

11. The image forming apparatus according to claim 1, further comprising a transferring unit configured to transfer an image to a recording medium that is either one of the first recording medium that has been conveyed from the tray and the second recording medium that has been conveyed by the conveying mechanism, and wherein the transferring unit includes:

a belt configured to bear toner thereon; and a secondary transfer roller configured to transfer the toner from the belt to the recording medium.

* * * * *